United States Patent [19]

Embry

[11] Patent Number: 4,761,309

[45] Date of Patent: Aug. 2, 1988

[54] COATING APPARATUS AND METHOD

[75] Inventor: Lamar Embry, Columbus, Miss.

[73] Assignee: Beloit Corporation, Beloit, Wis.

[21] Appl. No.: 603

[22] Filed: Jan. 5, 1987

[51] Int. Cl.[4] ..... B05C 5/02; B05D 1/26

[52] U.S. Cl. ..... 427/294; 118/50; 118/62; 118/410; 427/356

[58] Field of Search ..... 118/50, 62, 406, 410; 427/294, 296, 356

[56] References Cited

U.S. PATENT DOCUMENTS 4,497,273 2/1985 Mitter ..... 118/50

4,534,309 8/1985 Damrau et al. ..... 118/410

*Primary Examiner*—John P. McIntosh

*Attorney, Agent, or Firm*—Dirk J. Veneman; Raymond W. Campbell; David J. Archer

[57] ABSTRACT

A coating apparatus is disclosed for applying a coating onto a surface of a moving web. The apparatus includes a backing member which defines a perforate surface such that when the member is connected to a source of partial vacuum, the web is drawn towards the perforate surface of the member. A coating blade is disposed adjacent to the backing member such that the blade urges the web towards the perforate surface. A permeable belt extends around the backing member with the belt being disposed between the web and the backing member such that when the source of partial vacuum is connected to the backing member, air flows through the belt and the perforate surface for drawing the web into close conformity with the belt. The belt and the web then move together in the same direction for inhibiting the buildup of deleterious material adjacent to the blade that would otherwise remain adjacent to the blade causing marking of the coating applied to the surface of the web by the blade.

11 Claims, 3 Drawing Sheets

COATING APPARATUS AND METHOD

BACKGROUND OF THE INVENTION

1. Field Of The Invention

This invention relates to a coating apparatus for applying a coating onto a surface of a moving web. More particularly, this invention relates to a short dwell coating apparatus for coating a surface of a paper web.

2. Information Disclosure Statement

In recent years, much research has been carried out in an effort to efficiently coat a surface of a paper web with coating material. In the prior art, various methods have been employed for applying such coating material including feeding a web around a backing roll, precoated by an application roll for applying coating to the web. With most of these methods, a blade disposed downstream relative to the coating material pond urges the coated web against the backing roll for removing excess coating material from the web.

More recently, the so-called short dwell coater has been introduced which avoids the problems associated with an open pond of coating material. The short dwell coater enables coating material under hydraulic pressure to be applied to a limited area of a moving web with a flexible blade defining the downstream edge of such area. Any excess coating material flows from such area away from the blade in a direction opposite to the direction of movement of the web. Among the advantages provided by such short dwell coaters may be included the short time that the coating material is disposed in contact with the web prior to removal of excess coating material by the blade. Such short time period inhibits absorption of the coating material throughout the web. By use of such short dwell coater, less water is forced into the web thereby resulting in a stronger web at the blade. Because the short dwell coater technique is more of a surface application, there is a decrease in blade pressure and consequently, a reduction in the number of web breaks which occur during the coating operation.

The short dwell coater presents many advantages over the prior art coating methods. However, a problem exists with the short dwell coater when such coater is used to coat a web moving at high speed. When the web is moving in the region of 3,000 or more feet per minute past the short dwell coater, there is a tendency for an air pocket to develop between the backing roll and the web upstream relative to the short dwell coater. Because of the relatively short period of time that the coating material is in contact with the web prior to excess coating material being removed by the blade, the aforementioned air pocket, when coating at high speeds has sometimes resulted in web breakage and streaking. Furthermore, there exists a tendency for any particles of contamation on the surface of the web or in the short dwell coating pond to become lodged against the blade thereby causing marking of the surface of the coating and sheet breaks.

The present invention overcomes the aforementioned problems by the provision of a backing roll having a perforate surface with a permeable belt disposed between the perforate surface and the web. When a vacuum is applied to the backing member, the web is drawn into close conformity with the belt thereby inhibiting the generation of an air pocket between the web and the backing member and preventing streaking, lodging or hangup of deleterious material adjacent to the blade.

The primary objective of the present invention is the provision of a coating apparatus that overcomes the aforementioned problems associated with the prior art coating apparatus and that provides a significant contribution to the art of coating moving webs.

Another object of the present invention is the provision of a coating apparatus including a backing member defining a perforate surface. The coating apparatus further includes a permeable belt extending around the backing member and disposed between the web and the backing member such that when a source of partial vacuum is connected to the backing member, air flows through the permeable belt and the perforate surface for drawing the web into close conformity with the belt so that the belt and web move together and in the same direction for inhibiting the buildup of deleterious material adjacent to a coating blade.

Another object of the present invention is the provision of a coating apparatus in which the permeable means is a wire mesh belt which includes a first layer disposed contiguous relative to the perforate surface and a second layer disposed contiguous relative to the first layer with the second layer being disposed contiguous relative to the web. The second layer is of a finer mesh relative to the mesh of the first layer such that during coating of the web, vacuum applied through the perforate surface is evenly distributed by means of the first layer and the second layer inhibits marking of the contiguous surface of the web.

Other objects and advantages of the present invention will be apparent to those skilled in the art by a consideration of the detailed description set forth hereinafter taken in conjunction with the annexed drawings and the appended claims.

SUMMARY OF THE INVENTION

The present invention relates to a coating apparatus and method for applying a coating onto a surface of a moving web. The apparatus includes a backing member which defines a perforate surface such that when the member is connected to a source of partial vacuum, the web is drawn towards the perforate surface of the member. A coating blade is disposed adjacent to the backing member such that the blade urges the web towards the perforate surface. A permeable means extends around the backing member with the permeable means being disposed between the web and the backing member such that when the source of partial vacuum is connected to the backing member, air flows through the permeable means and the perforate surface for drawing the web into close conformity with the permeable means so that the permeable means and the web move together in the same direction for inhibiting hangup of deleterious material adjacent to the blade that would otherwise cause sheet breaks and marking of the coating applied to the surface of the web by the blade.

Due to the small area of contact of the sheet with the backing roll, the backing roll usually travels faster than the sheet. There is normally a layer of air between the sheet and the backing roll, so there is backing roll slippage. With a vacuum in the backing member, sheet contact with the belt is insured, eliminating slippage. The vacuum-held sheet is pulled past the blade. Some sheet defects will also be pulled past the blade resulting in better runnability, or fewer sheet breaks.

With a vacuum-held sheet, good results will be realized with a conventional coater utilizing an applicator roll or with a short dwell coater.

In a more specific embodiment of the present invention, the backing member is a rotatable suction roll.

In another embodiment of the present invention, the backing member is a vacuum box.

More specifically, the rotatable suction roll also includes a rotatable outer shell which defines the perforate surface. Furthermore, in the alternative embodiment, the vacuum box includes a wall disposed contiguous relative to the permeable means, the wall defining the perforate surface.

More particularly, the coating blade is a short dwell coating head or a conventional coater head with an applicator roll. The permeable means is a continuous belt. The belt is a wire mesh having a first layer disposed contiguous relative to the perforate surface. A second layer of the belt is disposed contiguous relative to the first layer with the second layer being disposed contiguous relative to the web. The second layer is of a finer mesh relative to the mesh of the first layer such that during coating of the web the vacuum applied through the perforate surface is evenly distributed by means of the first layer, Furthermore, the second layer inhibits marking of the contiguous surface of the web.

In addition to the inhibition of the buildup of deleterious material adjacent to the blade that would otherwise cause marking of the coating applied to the web and/or sheet breaks, the coating apparatus of the present invention also inhibits the generation of an air pocket between the backing member and web upstream relative to the coating blade.

The present invention provides a method of applying a coating onto the surface of a moving web, such method comprising the steps of connecting a backing member to a source of partial vacuum such that the web is drawn towards a perforate surface defined by the backing member. The next step includes pressing the web towards the perforate surface by means of a short dwell coating head or a conventional coater disposed adjacent to the backing member. A third step includes interposing a permeable belt between the perforate surface of the backing member and the web such that when the partial vacuum is applied through the perforate surface and the permeable belt, the web is drawn into close conformity with the belt for firstly, inhibiting the buildup or hangup of deleterious material adjacent to the blade, and secondly for inhibiting the generation of an air pocket between the backing member and the web upstream relative to the blade.

Although the present invention, as disclosed hereinbefore has been described particularly with reference to a short dwell coater for applying a coating to a moving web of paper, it should be understood by those skilled in the art that the present invention is not limited to such short dwell coaters but includes other types of coaters with a trailing blade to meter the application of the coating to the sheet. Furthermore, the present invention includes the application of any coating material or sizing composition or additive to the surface of any moving web.

BRIEF DESCRIPTION OF THE DRAWINGS

Similar reference characters refer to similar parts throughout the various embodiments of the present invention.

DETAILED DESCRIPTION OF THE DRAWINGS

Figure 1:
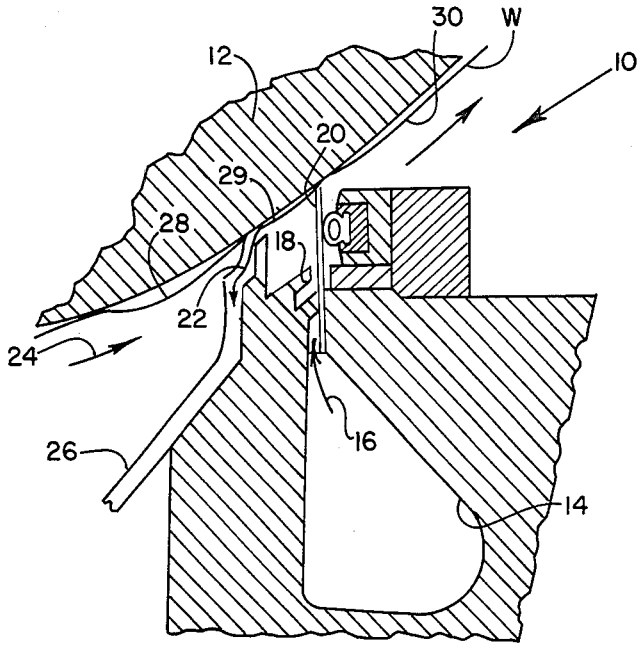
FIG. 1 (PRIOR ART)
FIG. 1 is a fragmentary sectional view of a prior art short dwell coater cooperating with a backing roll showing an air pocket generated between the backing roll and the web.

FIG. 1 is a fragmentary sectional view of a prior art short dwell coater generally designated 10. The coater 10 cooperates with a backing member 12 such that a web W is disposed and moves between the backing member 12 and the coater 10. Pressurized coating material is disposed within a header 14 defined by the coater 10. The coating material flows as indicated by the arrow 16 into a short dwell coating pond 18 so that a relatively small area of the moving web W is contacted by the coating material as the web W travels past the coating pond 18. A flexible coating blade 20 urges the web W against the backing member 12 such that the coating blade 20 defines an edge of the coating pond 18 so that excess coating material removed from the web W by the coating blade 20 is urged away from the web W as indicated by the arrow 22 in a direction opposite to the direction of movement of the web W as indicated by the arrow 24. Such excess coating material is returned through a coating return 26 so that such coating material may be filtered and re-pressurized.

As shown in FIG. 1, there exists a tendency for the generation of air pockets 28 and 29 between the backing member 12 and the web W upstream relative to the coating pond 18. Such air pocket 28, especially when the web W is moving at speeds in excess of 3,000 feet per minute, tends to cause web breakage. Furthermore, deleterious material attached to the web W upstream relative to the coater 10 tends to become lodged—adjacent to the coating blade 20 thereby causing marking of the resultant coating 30.

Figure 2:
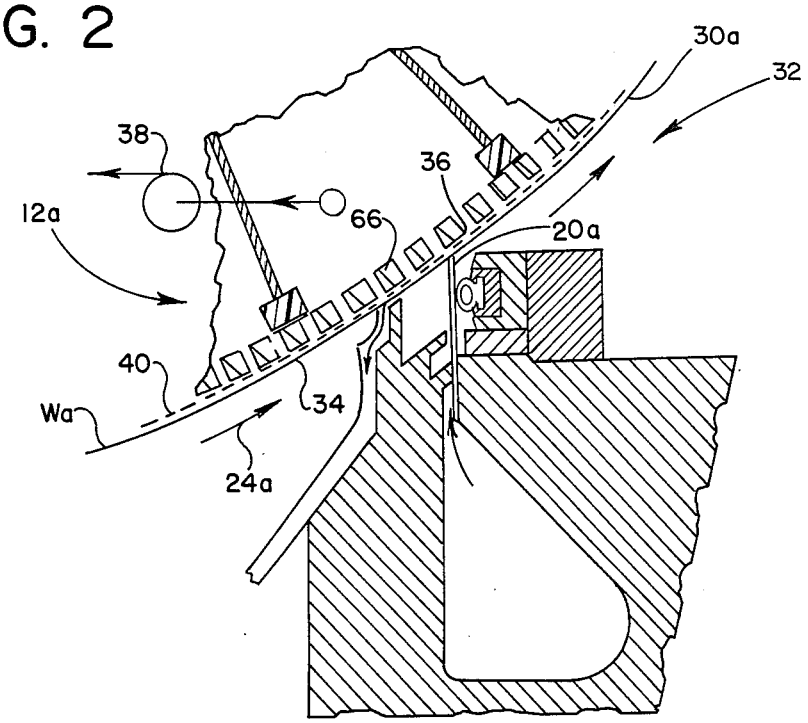
FIG. 2 is a fragmentary sectional view of the coating apparatus according to the present invention.

FIG. 2 is a fragmentary sectional view of a coating apparatus according to the present invention. The coating apparatus generally designated 32 applies a coating **30*a* onto a surface 34 of a moving web Wa. The apparatus 32 includes a backing member generally designated 12*a* which defines a perforate surface 36 such that when the member 12*a* is connected to a source of partial vacuum 38, the web Wa is drawn toward the perforate surface 36 of the member 12*a*. A coating blade 20*a* is disposed adjacent to the backing member 12*a* such that the blade 20*a* urges the web Wa towards the perforate surface 36. A permeable means generally designated 40 extends around the backing member 12*a*. The permeable means 40 is disposed between the web Wa and the backing member 12*a* such that when the source of partial vacuum 38 is connected to the backing member 12*a*, air flows through the permeable means 40 and the perforate surface 36 for drawing the web Wa into close conformity with the permeable means 40 so that the permeable means 40 and the web Wa move together and in the same direction as indicated by the arrow 24*a* for inhibiting the buildup of deleterious material adjacent to the blade 20***a* that would otherwise remain adjacent to the blade 20*a* causing marking of the coating 30*a* applied to the surface 34 of the web Wa by the blade 20*a*.

As shown in FIG. 2, the backing member 12*a* is a rotatable suction roll.

Figure 3:
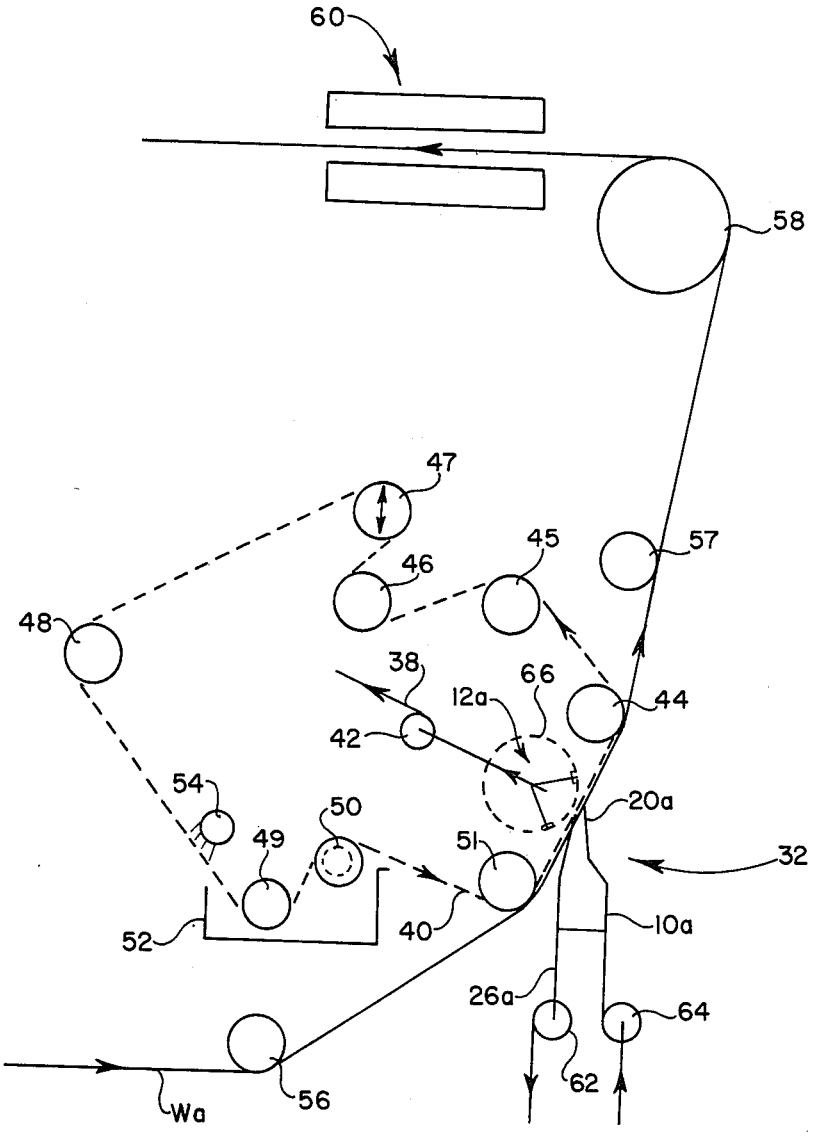
FIG. 3 is a side elevational view showing the coating apparatus of FIG. 2 and the arrangement of the permeable means relative to the rotatable suction roll.

FIG. 3 is a side-elevational view of the coating apparatus shown in FIG. 2 and shows the backing member 12*a* as a rotatable suction roll which is connected to the source of partial vacuum 38 as indicated by the vacuum pump 42. The permeable means 40 extends around a plurality of rolls 44,45,46,47,48, 49,50 and 51. Roll 47 is adjustable such that the tension of the permeable means 40 may be adjusted to the required optimum coating capability of the apparatus. Roll 49 is immersed in a washing tank 52 filled with washing liquid for removing cleansing material applied by a shower 54 disposed between rolls 48 and 49. The permeable means 40 extends away from the tank 52 and around roll 50 which is a suction roll and thereafter extends around roll 51.

The web Wa extends around a plurality of rolls of which rolls 56,51,44,57 and 58 are shown in FIG. 3. During passage between rolls 51 and 44, the web Wa is in contiguous relationship relative to the permeable means 40 such that the web Wa is disposed between the permeable means 40 and the coating blade 20*a* of the coating apparatus 32.

The arrangement of the present invention enables on-line coating of the web Wa because such coating material may be applied to the web Wa at web speeds in excess of 3,000 feet per minute. As shown in FIG. 3, an infrared heating device generally designated 60 is used to dry the coated web. The short dwell coater 10*a* includes a pump 62 connected to the coating return line 26*a* such that excess coating material may be returned to the short dwell coater 1O*a*. A second pump 64 feeds coating material to the short dwell coater 10*a*.

As shown in FIG. 2, the rotatable suction roll 12*a* includes a rotatable outer shell 66 which defines the perforate surface 36. The coating blade 20*a* is a short dwell coating blade and the permeable means 40 is a continuous belt.

Figure 4:
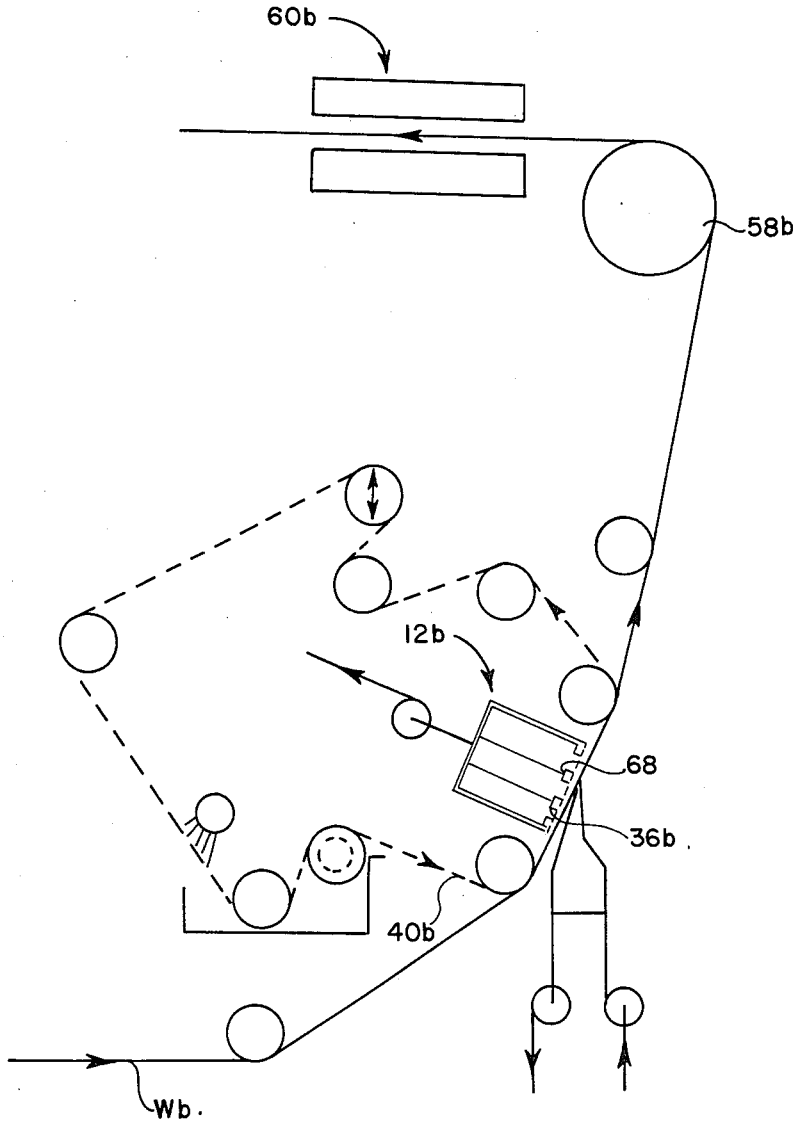
FIG. 4 is a side elevational view of an alternative embodiment of the invention in which the backing member is a vacuum box.

FIG. 4 is a similar view to that shown in FIG. 3 but shows the rotatable suction roll 21*a* replaced by a vacuum box generally designated 12*b*. The vacuum box 12*b* includes a wall 68 which is disposed contiguous relative to the permeable means 40*b*. The wall 68 defines the perforate surface 36*b*.

Figure 5:
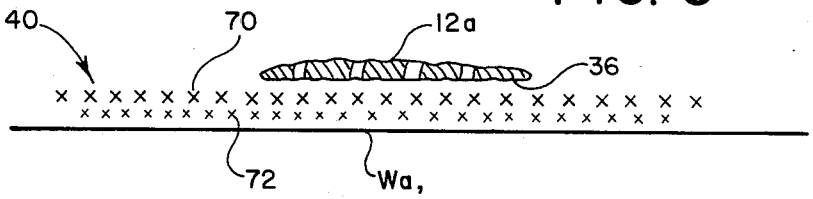
FIG. 5 is a sectional view of the permeable means showing the first and second layers thereof.

FIG. 5 is a sectional view of the permeable means 40. The permeable means 40 as shown in FIG. 5 is a continuous wire mesh belt which includes a first layer 70 disposed contiguous relative to the perforate surface 36 or 36*b* and a second layer 72 which is disposed contiguous relative to the first layer 70. The second layer 72 is disposed contiguous relative to the web Wa or Wb with the second layer 72 being of a finer mesh relative to the mesh of the first layer 70 such that during coating of the web, vacuum applied through the perforate surface is evenly distributed by the first layer 70 and the second layer 72 inhibits marking of the contiguous surface of the web.

In operation of the apparatus as shown in FIGS. 2 and 3, the rotatable suction roll 12*a* is connected to a source of partial vacuum 38 such that the web Wa is drawn towards the perforate surface 36 defined by the rotatable outer shell 66. The web Wa is pressed towards the perforate surface 36 by means of the short dwell coating blade 20*a* disposed adjacent to the backing member 12*a*. The continuous belt 40 is interposed between the perforate surface 36 and the web Wa such that when the partial vacuum is applied to the perforate surface 36 and the permeable belt 40 the web Wa is drawn into close conformity with the belt 40 for firstly inhibiting the buildup of deleterious material adjacent to the blade 20*a* and secondly for inhibiting the generation of any air pocket between the backing member 12*a* and the web Wa upstream relative to the blade 20*a*.

The provision of a wire mesh belt having a first and second layer 70 and 72 respectively enables even distribution by means of the first layer 70 of the vacuum applied to the web Wa. The finer mesh second layer 72 avoids any possibility of marking the uncoated surface of the web Wa during passage past the backing member 12*a*.

The present invention enables the continuous coating of a web at high speed without the associated problem of buildup of deleterious material adjacent to the coating blade. By reason of the application of vacuum, the web is caused to move at the same speed and in the same direction as the permeable means so that any deleterious material disposed within the coating pond adjacent to the coating blade tends to be dragged past the coating blade rather than lodging adjacent thereto. Also, by the provision of a vacuum through the backing member, the generation of an air pocket with associated web breakage is inhibited.

What is claimed is:

1. A coating apparatus for applying a coating onto a surface of a moving web, said apparatus comprising:

a backing member defining a preforate surface such that when said member is connected to a source of partial vacuum, the web is drawn toward said perforate surface of said member;

a coating blade disposed adjacent to said backing member such that said blade urges the web toward said perforate surface;

permeable means extending around said backing member, said means being disposed between the web and said backing member such that when said source of partial vacuum is connected to said backing member, air flows through said permeable means and said perforate surface for drawing the web into close conformity with said permeable means so that said permeable means and the web move together and in the same direction for inhibiting the buildup of deleterious material adjacent to said blade that would otherwise remain adjacent to said blade causing marking of the coating applied to the surface of the web by said blade;

said permeable means being a continuous belt;

said belt further including:

a first layer disposed contiguous relative to said perforate surface; and a second layer disposed contiguous relative to said first layer, said seocnd layer being disposed contiguous relative to the web, said second layer being of a finer mesh relative to the mesh of said first layer such that during coating of the web, said vacuum applied through said perforate surface is evenly distributed by means of said first layer and said second layer inhibits marking of said contiguous surface of the web.

2. A coating apparatus as set forth in claim 1 wherein said backing member is a suction roll.

3. A coating apparatus as set forth in claim 2 wherein said suction roll is rotatable.

4. A coating apparatus as set forth in claim 3 wherein said rotatable suction roll further includes:

a rotatable outer shell which defines said perforate surface.

5. A coating apparatus as set forth in claim 1 wherein said backing member is a vacuum box.

6. A coating apparatus as set forth in claim 5 wherein said vacuum box further includes:

a wall disposed contiguous relative to said permeable means, said wall defining said perforate surface.

7. A coating apparatus as set forth in claim 1 wherein said coating blade is a short dwell coating blade.

8. A coating apparatus as set forth in claim 1 wherein said continuous belt is a wire mesh belt.

9. A coating apparatus for applying a coating onto a surface of a moving web, said apparatus comprising:

a backing member defining a perforate surface such that when said member is connected to a source of partial vacuum, the web is drawn toward said perforate surface of said member;

a coating blade disposed adjacent to said backing member such that said blade urges the web toward said perforate surface;

permeable means extending around said backing member, said means being disposed between the web and said backing member such that when said source of partial vacuum is connected to said backing member, air flows through said permeable means and said perforate surface for drawing the web into close conformity with said permeable means so that said permeable means and the web move together and in the same direction for inhibiting the buildup of deleterious material adjacent to said blade that would otherwise remain adjacent to said blade causing marking of the coating applied to the surface of the web by said blade, said permeable means being a continuous wire mesh belt;

including:

a first layer disposed contiguous relative to said perforate surface; and a second layer disposed contiguous relative to said first layer, said second layer being disposed contiguous relative to the web, said second layer being of a finer mesh relative to the mesh of said first layer such that during coating of the web, said vacuum applied through said perforate surface is evenly distributed by means of said first layer and said second layer inhibits marking of said contiguous surface of the web.

10. A coating apparatus for applying a coating onto a surface of a moving web, said apparatus comprising:

a backing member, said member defining a perforate surface such that when said member is connected to a source of partial vacuum, the web is drawn toward said perforate surface of said member;

a short dwell coating blade disposed adjacent to said backing member such that said blade urges the web toward said perforate surface;

permeable means extending around said backing member said means being disposed between the web and said backing member such that when said source of partial vacuum is connected to said backing member, air flows through said permeable means and said perforate surface for drawing the web into close conformity with said permeable means so that said permeable means and the web move together and in the same direction for inhibiting the buildup of deleterious material adjacent to said blade that would otherwise remain adjacent to the blade causing marking of the coating applied to the surface of the web by the blade and further inhibiting the generation of an air pocket between said backing member and the web upstream relative to said coating blade;

said permeable means being a continuous belt;

said belt further including:

a first layer disposed contiguous relative to said perforate surface; and a second layer disposed contiguous relative to said first layer, said second layer being disposed contiguous relative to the web, said second layer being of a finer mesh relative to the mesh of said first layer such that during coating of the web, said vacuum applied through said perforate surface is evenly distributed by means of said first layer and said second layer inhibits marking of said contiguous surface of the web.

11. A method of applying a coating onto a surface of a moving web, said method comprising the steps of:

connecting a backing member to a source of partial vacuum such that the web is drawn toward a perforate surface defined by the backing member;

pressing the web towards the perforate surface by means of a short dwell coating blade disposed adjacent to the backing member; and interposing a permeable belt between the perforate surface of the backing member and the web such that when the partial vacuum is applied through the perforate surface and the permeable belt, the web is drawn into close conformity with the belt for firstly inhibiting the buildup of deleterious material adjacent to the blade, and secondly for inhibiting the generation of an air pocket between the backing member and the web upstream relative to the blade, the permeable belt having a first layer which is disposed contiguous relative to the perforate surface and a second layer disposed contiguous relative to the first layer, the second layer being disposed contiguous relative to the web, the second layer having a finer mesh relative to the mesh of the first layer such that during coating of the web, the vacuum applied through the perforate surface is evenly distributed by means of the first layer and on the second layer inhibits marking of the contiguous surface of the web.

* * * * *